United States Patent [19]

Schneekluth

[11] Patent Number: 4,804,312

[45] Date of Patent: Feb. 14, 1989

[54] FLOW GUIDE FOR SHIP PROPELLERS

[76] Inventor: Herbert Schneekluth, No. 6, An Adamshäuschen, 5100 Aachen, Fed. Rep. of Germany

[21] Appl. No.: 103,784

[22] Filed: Oct. 2, 1987

[30] Foreign Application Priority Data

Oct. 3, 1986 [DE] Fed. Rep. of Germany ..... 3633689

[51] Int. Cl.[4] ..... B63H 5/16

[52] U.S. Cl. ..... 415/182; 440/67; 440/71

[58] Field of Search ..... 416/247 R; 415/182, 415/183, 185, 208; 114/57; 440/66, 67, 71; 60/221

[56] References Cited

U.S. PATENT DOCUMENTS

| | | | |
|---|---|---|---|
| 682,027 | 9/1901 | Burgess | 440/66 |
| 904,313 | 11/1908 | Davis | 440/66 |
| 1,801,875 | 4/1931 | Melcher | 114/57 |
| 3,508,517 | 4/1970 | Hannan | 440/67 |
| 4,240,251 | 12/1980 | Fuller | 440/71 X |

FOREIGN PATENT DOCUMENTS

| | | | |
|---|---|---|---|
| 858213 | 10/1952 | Fed. Rep. of Germany . | |
| 2250754 | 4/1973 | Fed. Rep. of Germany | 440/67 |
| 3216578 | 10/1983 | Fed. Rep. of Germany . | |
| 238586 | 8/1986 | Fed. Rep. of Germany | 440/66 |
| 241056 | 11/1986 | Fed. Rep. of Germany | 440/67 |
| 2177365 | 1/1987 | United Kingdom . | |

*Primary Examiner*—Robert E. Garrett
*Assistant Examiner*—Joseph M. Pitko
*Attorney, Agent, or Firm*—John C. Smith, Jr.

[57] ABSTRACT

This arrangement concerns a flow guide surface for ship propellers, at least for twin propellers, the propellers being mounted by means of propeller brackets. It is provided for to arrange, at least in the region between the arms of the propeller brackets, a sectioned arcuate guide surface. This guide surface possesses a mean camber line converging backwardly towards the propeller shaft and the outlet edge has a distance to the propeller shaft amounting to between 70 and 130% of the propeller radius. This arcuate section of the guide surface is connected, on the side facing the ship's hull, to an approximately horizontal radial part.

2 Claims, 5 Drawing Sheets

FLOW GUIDE FOR SHIP PROPELLERS

BACKGROUND OF THE INVENTION

This invention relates to a flow guide for ship propellers in which the propeller shafts are rotatably supported adjacent the propellers by propeller brackets. The flow guide has a sectioned and arcuate configuration and is arranged transversely to the direction of flow upstream of the propeller. The arcuate guide extends at least between a pair of arms of the propeller bracket which arms project radially from the propeller bracket nut, in which the shaft is rotatably mounted, to the ship's hull.

In the case of ships with twin propellers, the propeller shafts usually project rearwardly a substantial distance from the hull, and consequently it is necessary to support the propeller shafts adjacent their ends. This is usually effected by propeller brackets having at least two arms which extend between the propeller bracket nut, adjacent the propeller, and the ship's hull. The propeller shafts are guided inclinedly relative to the flow direction by the propeller brackets which brake the flow velocity and increase thereby the wake which is produced by the marginal layer of the ship's hull and the separation of the flow. The irregularity of the flow to the propeller results in a reduction in its efficiency. The region of such low flow velocity is at the same time a region of high local propeller stress. Consequently, stronger pressure pulses are exerted on the adjacent areas of the ship's hull surface. Due to the high tangential stress and the relatively small water column above this area, this region is particularly endangered by cavitations.

Various constructive measures have been attempted in the prior art for the purpose of making the flow velocity to the propeller more uniform. Propeller brackets have been utilized which have a single arm extending between the propeller bracket nut and the ship's hull. The disadvantage of this construction is that a single arm necessarily has a large cross-sectional area.

Shafts of the Grim type, in which the propeller shaft is guided in a resilient pipe at the end of which, facing the propeller, a supporting bearing is located, have been used.

The arms of the propeller brackets have been shaped as guide surfaces to form a nozzle arrangement. In some instances the arms of the propeller brackets have been formed to provide a counter twist to the flow.

Attempts have been made to shield the ship's hull against the propeller affect by means of a metal sheet arranged in the direction of flow between the propeller and the skin of the ship. This arrangement does not eliminate irregularity in the flow, though the pressure pulses are intercepted.

Attempts have been made to utilize a horizontal guide surface arranged between the propeller bracket nuts or at the height of the upper blades of the propeller. This guide surface uses, to the extent it is arranged in the flow to the propeller, the initial twist for propulsion purposes so that substantial power savings can be effected. This guide surface does, however, not accelerate the flow to the upper propeller blades. Rather a delay affect will occur which results in the upper propeller blades being stressed more heavily and in the emission of stronger pressure pulses so that stronger vibrations are created. The German periodical "Hansa", 1970, No. 18, pages 1519–1524, describes such a horizontal guide surface for twin propeller arrangements.

SUMMARY OF THE INVENTION

An object of the present invention is to avoid the various above-mentioned disadvantages and to provide an arrangement which makes possible a compensation of the flow to the propeller together with an improvement in the efficiency of the propeller and which at the same times avoids the formation of strong pressure pulses on the skin of the ship.

To attain this object, the present invention provides a flow guide for ship propellers, in particular twin propellers, which are mounted on shafts rotatably supported by propeller brackets. The flow guide is of sectioned and arcuate configuration, the arc being arranged transversely to the direction of flow upstream of the propeller at least in the region between pairs of arms of the propeller brackets extending between the propeller bracket nut and the hull of the ship. The arcuate guide has a convex flow guide surface on the side facing the propeller shaft and propeller bracket nut. The mean camber line of the guide, a straight line which extends along the geometric center of the guide, descends rearwardly towards the propeller shaft, the distance of the mean camber line to the propeller shaft being between about 70 and 130% of the propeller radius. A support member extends substantially horizontally from the midship end of the guide to the propeller bracket nut.

The flow guide of the present invention increases the velocity of flow to the propeller in the region enclosed by the guide surface. This local increase of the flow velocity is in a region of a strong wake. The result is a compensation of the flow to the propeller and improved efficiency of the propeller. Also, the initial twist induced by the propeller in the region between the shafts and the hull may be utilized so that the guide surface has a resulting buoyant force which possesses a propulsion component. Thus, larger power savings are possible with the additional radial guide surface part and the propeller beating upwardly and outwardly rather than beating inwardly.

The guide of the present invention has the advantage that the upper propeller blade tips are relieved due to higher flow velocities. This results in further cost savings, i.e.:

a. The distances of the propeller blade tips from the skin of the ship and of the propeller brackets may be maintained shorter. Thus, the resistance of the propeller brackets and the inclined shafts becomes smaller.

b. By means of the flow guide, the arms of the propeller brackets are statically relieved, and thus their dimensions may be reduced.

c. When designing the propeller less attention may be given to vibrations. The blade tip relief may be reduced or omitted. The pitch at the blade tips need not be reduced and the length of the section need not be shortened in the outer regions. Also, a skew back form is unnecessary.

The affect of the guide of the present invention is substantially improved if the arcuate guide extends beyond the pair of arms of the propeller bracket. A still further improvement is obtained if the section of the guide surface has an arcuate configuration such that the rear end of the guide follows the contraction of the jet.

To relieve the propeller blade tips and to reduce vibrations the guide of the present invention may be provided with air outlet openings in the guide surface for supplying air to the flow to the propeller. The affect of air supplied to the propeller is known in the art. However, in the prior art the air is guided through a separate pipe system or via a conduit system laid through the propeller. A pipe system causes further resistance, and to supply air through the propeller is costly. With the arrangement disclosed herein it is possible to limit the supply of air to the upper propeller region only.

BRIEF DESCRIPTION OF THE DRAWINGS

An embodiment of the invention will now be described by way of example and with reference to the accompanying drawings in which.

DESCRIPTION OF THE PREFERRED EMBODIMENTS

Figure 1:
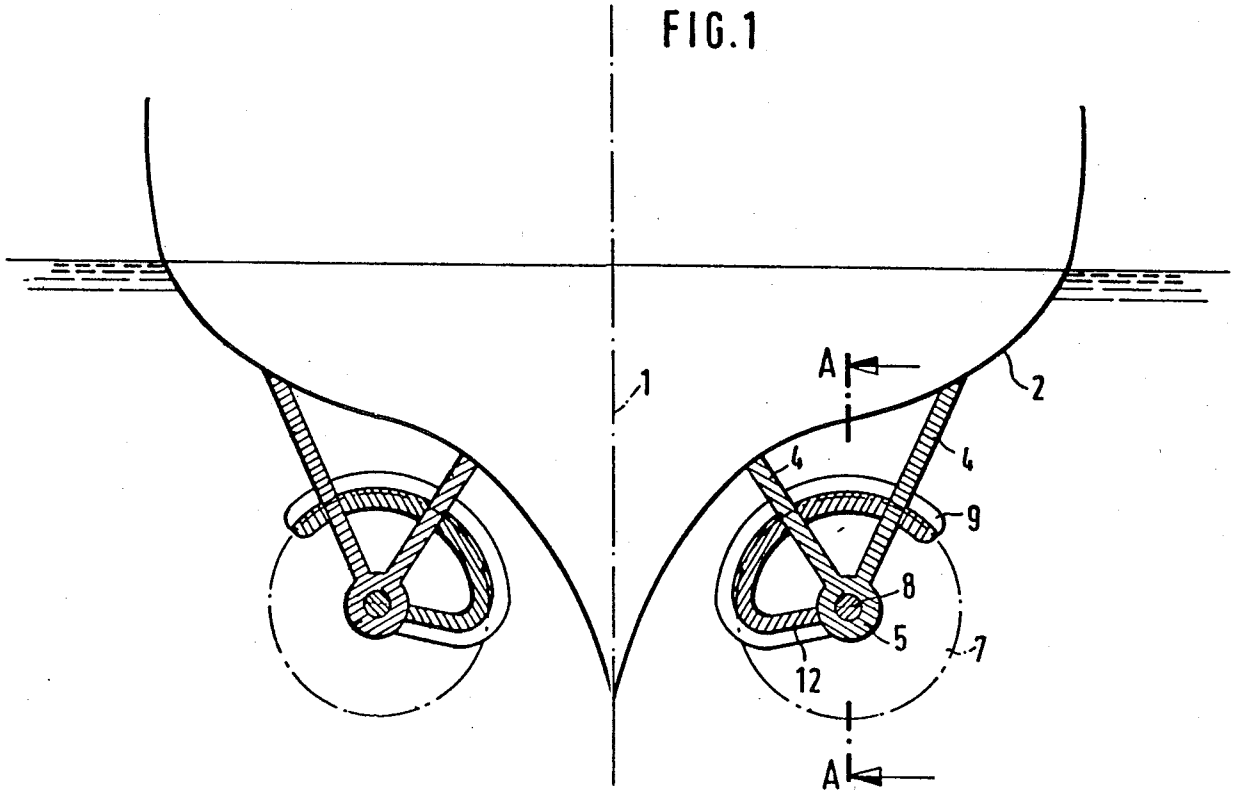
FIG. 1 is a rear view, partly in section, of a part of a ship incorporating the guide of the present invention, the section being taken on the line B—B of FIG. 2.

FIGS. 1–4 illustrate the propeller region of a ship's hull including the plane 1 amidships, a frame contour 2 and a counterline 3. A propeller 6 is supported on the end of its propeller shaft 8 which in turn is rotatably supported adjacent the propeller by a propeller bracket nut 5 and a pair of spaced arms 4 extending radially from the nut to the hull of the ship.

Figure 3:
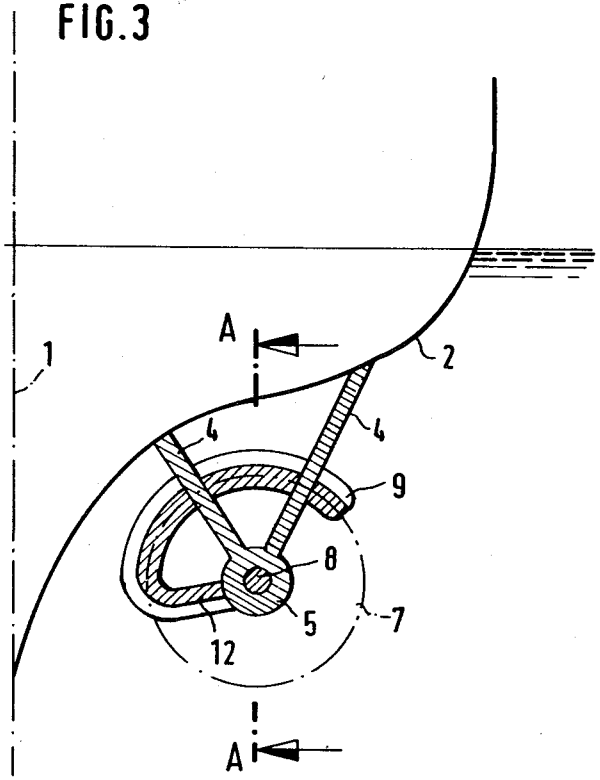
FIG. 3 is a rear view, partly in section, of a part of a ship incorporating a different embodiment of the guide of the present invention, the section being taken on the line B—B of FIG. 4.

An arcuately shaped guide 9 is mounted on the arms 4 above the propeller shaft 8 and the propeller bracket nut 5. The guide 9 extends at least between the arms 4 and, as shown in FIGS. 1 and 3, may project beyond the arms 4. The portion of the arcuate guide 9 adjacent the hull may extend downwardly to a point approximately in a horizontal plane with the propeller shaft 8 where a leg 12 of the guide 9 extends substantially horizontally to join the propeller bracket nut 5.

Figure 2:
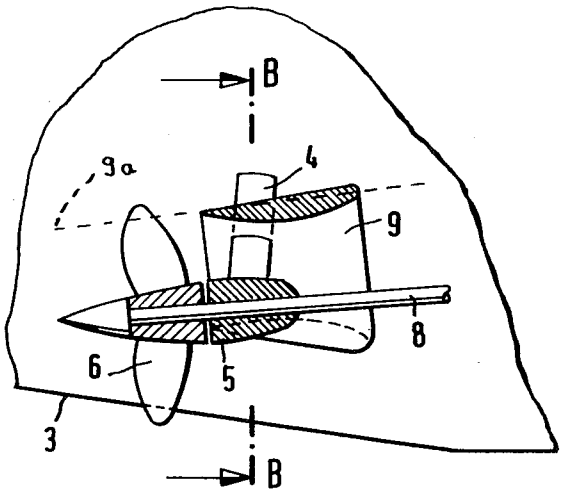
FIG. 2 is a side view, partly in section, of a part of the ship shown in FIG. 1, said section being taken along the line A—A of FIG. 1.
Figure 4:
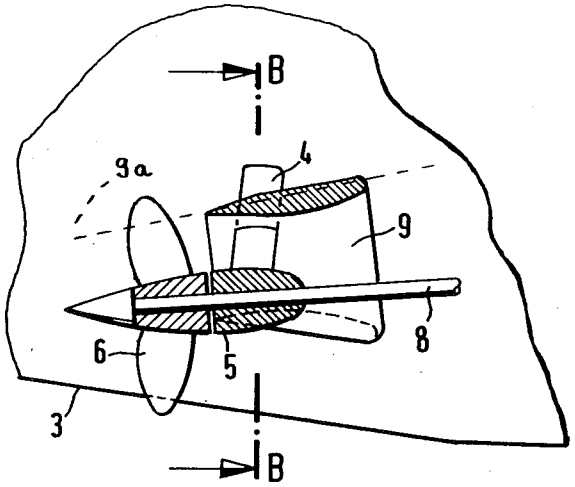
FIG. 4 is a side view, partly in section, of the part of the ship shown in FIG. 3, said section being taken along the line A—A of FIG. 3.

The guide 9 as shown in FIGS. 1 and 2 has an upper surface which is substantially flat and a lower convex flow guide surface facing the propeller shaft 8 and propeller bracket nut 5. The embodiment shown in FIGS. 3 and 4 is similar to that shown in FIGS. 1 and 2 except that the upper surface is slightly convex towards the rear end of the guide.

The guide 9 has a straight mean camber line (shown by dotted line 9*a*) passing through the geometric center of the guide 9. The guide is arranged such that this mean camber line 9*a* descends rearwardly towards the propeller shaft. The distance between the mean camber line and the propeller shaft must be between 70% and 130% of the radius of the propeller.

The guide 9 serves to increase the velocity of the flow to the propeller in the region of the guide. The front edge of the guide 9 is at a greater distance from the propeller shaft 8 than the rear edge of the guide. This local increase of the flow velocity takes place in the region of a stronger wake and results in a uniform flow to the propeller as well as, at the same time, an improvement in the efficiency of the propeller.

The drawings show the hull of the ship extending downwardly between the propeller brackets. In this case the wake in the propeller region is distributed irregularly. In the case of a ship with a flat stern with no parts of the ship's hull extending between the propellers, the wake heavily increases from the center of the propeller to the midships' plane.

Figure 6:
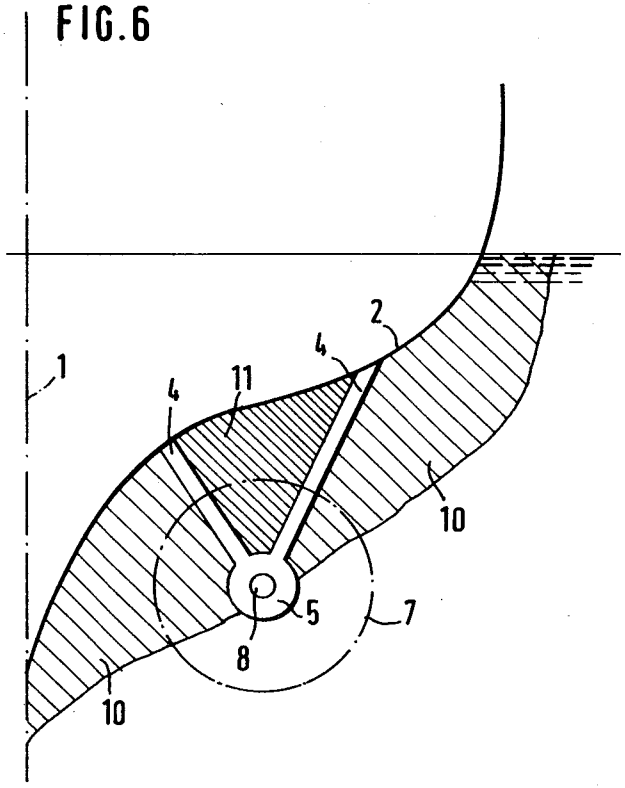
FIG. 6 is a representation of the wake field without the guide of the present invention.
Figure 5:
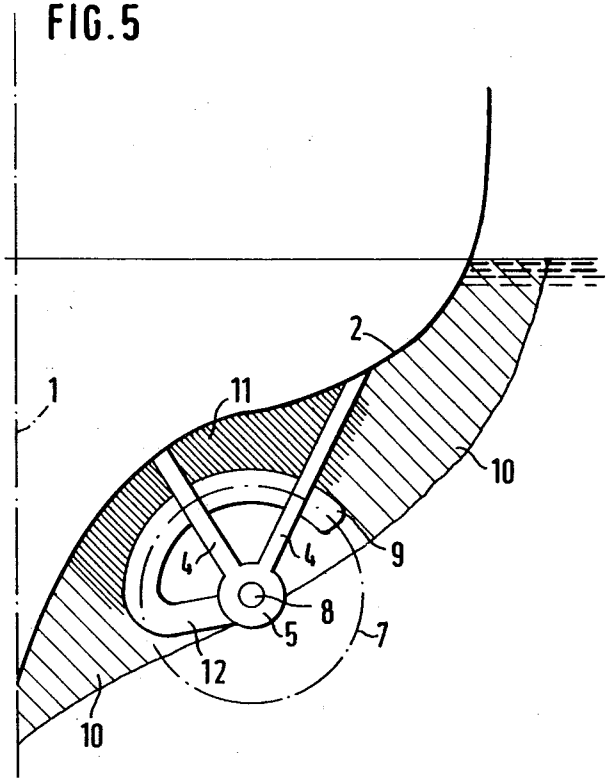
FIG. 5 is a representation of the wake field created by the surface of the guide according to the present invention.

FIGS. 5 and 6 show wake fields. The wake field in the hatched region 10 is of a moderate characteristic while the region 11 between the arms 4 is of a stronger characteristic. FIG. 5 demonstrates that the guide 9 influences the wake field resulting in a more uniform distribution of the flow velocity in the region of the flow to the propeller than is the case shown in FIG. 6 without the guide.

The flow guided through the guide 9 is accelerated, and the flow to the propeller is made uniform since the guide 9 is arranged upstream of the propeller 6 in the stronger wake. Also, the vibrations produced by the propeller are reduced to a large extent. Furthermore, the flow between the guide 9 and the skin of the ship's hull is delayed resulting in a reduction of the frictional resistance.

Figure 7:
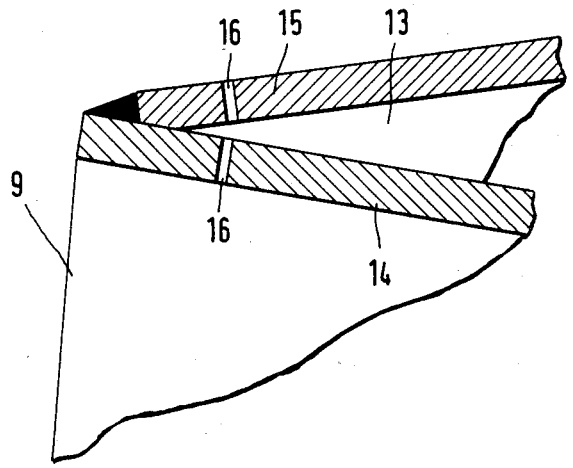
FIG. 7 is a perspective view, partly in section, of a part of an alternative embodiment of the guide of the present invention.

FIG. 7 shows a part of a further embodiment of the guide 9. In this embodiment the arcuate guide has an external configuration, with a lower convex flow guide surface, as shown in either FIG. 2 or FIG. 4. However, the guide contains an interior space 13 between the lower and upper walls 14, 15 with a plurality of outlet openings 16, adjacent the rear edge of the guide, communicating between the interior space 13 and the exterior of the guide. Pressurized air is fed into the interior space 13, as for example from the ship's hull through conduits (not shown) in arms 4. The pressurized air enters the flow to the propeller through outlet openings 16 adjacent the rear edge of the arcuate guide. The pressurized air in the flow to the propeller serves as a relief of the propeller tips, and also a reduction of the vibrations is achieved.

The invention may be embodied in other specific forms without departing from the spirit or essential characteristics thereof. The embodiments are therefore to be considered in all respects as illustrative and not restrictive.

What is claimed is:

1. A ship construction including guide means for propellers, including twin propellers, said ship construction comprising a hull; a rotatably driven shaft extending rearwardly from said hull; a propeller mounted on the rear end of said shaft; a propeller bracket for supporting said shaft adjacent said propeller, said propeller bracket comprising a propeller bracket nut rotatably supporting said shaft adjacent said propeller and at least two spaced arms projecting substantially radially from said propeller bracket nut, the ends of said arms opposite said propeller bracket nut being mounted on said hull; said guide means comprising a guide member having a sectioned and arcuate configuration and extending at least between said arms of said propeller bracket, said arcuate guide member being arranged transversely to the direction of flow upstream of said propeller and having a lower convex flow guide surface facing said propeller shaft and propeller bracket nut and having a straight mean camber line descending rearwardly towards said propeller shaft, the distance between said mean camber line and said propeller shaft being between 70% and 130% of the radius of said propeller, an end of said arcuate guide member adjacent said hull extending downwardly to a point approximately in a horizontal plane with said propeller shaft and having a leg of said guide member extending substantially horizontally between said end of said guide member and said propeller bracket nut.

2. A ship construction including guide means according to claim 1 wherein the flow through said propeller while rotating forms a jet which contracts, and said arcuate guide member is so configured that the rear end thereof follows the contraction of the jet.

* * * * *